US011250828B2

(12) United States Patent
Patterson et al.

(10) Patent No.: US 11,250,828 B2
(45) Date of Patent: Feb. 15, 2022

(54) FELT ARRAY

(71) Applicant: 3form LLC, Salt Lake City, UT (US)

(72) Inventors: Caleb Patterson, Seattle, WA (US); Guillaume Martin, Rochetoirin (FR)

(73) Assignee: 3FORM LLC, Salt Lake City, UT (US)

( * ) Notice: Subject to any disclaimer, the term of this patent is extended or adjusted under 35 U.S.C. 154(b) by 841 days.

(21) Appl. No.: 15/962,778

(22) Filed: Apr. 25, 2018

(65) Prior Publication Data

US 2018/0336875 A1 Nov. 22, 2018

Related U.S. Application Data

(60) Provisional application No. 62/508,529, filed on May 19, 2017.

(51) Int. Cl.

| | |
|---|---|
| ***G10K 11/02*** | (2006.01) |
| ***G10K 11/162*** | (2006.01) |
| ***F21V 21/14*** | (2006.01) |
| ***F21V 15/01*** | (2006.01) |
| ***F21S 2/00*** | (2016.01) |
| ***F21S 8/04*** | (2006.01) |
| ***G10K 11/16*** | (2006.01) |
| ***G10K 11/00*** | (2006.01) |

(Continued)

(52) U.S. Cl.

CPC ..... *G10K 11/162* (2013.01); *F21S 2/00* (2013.01); *F21S 8/04* (2013.01); *F21V 15/01* (2013.01); *F21V 21/008* (2013.01); *F21V 21/14* (2013.01); *G10K 11/002* (2013.01); *G10K 11/16* (2013.01); *F21Y 2115/10* (2016.08)

(58) Field of Classification Search

CPC ..... F21V 21/008; F21V 21/14; F21V 3/06; F21V 33/006; F21S 8/04; G10K 11/002; G10K 11/16; G10K 11/162; F21Y 2115/10; F21Y 2107/00

See application file for complete search history.

(56) References Cited

U.S. PATENT DOCUMENTS 3,364,349 A * 1/1968 Witz ..... F21V 1/00 362/358

D270,094 S 8/1983 Thual (Continued)

FOREIGN PATENT DOCUMENTS

FR 2405427 A1 * 5/1979 ..... F21V 1/06

OTHER PUBLICATIONS

Vapor Echo Cylinder (LX-VEC) data sheet (Year: 2013).*

(Continued)

*Primary Examiner* — Omar Rojas Cadima

(74) *Attorney, Agent, or Firm* — Workman Nydegger

(57) ABSTRACT

Embodiments are generally directed to a sound-dampening light fixture. In one embodiment, the sound-dampening light fixture includes the following: a structural center portion that includes a housing for a light source, and at least one interconnecting ring that includes connection points for connecting panels to the interconnecting ring. The sound-dampening light fixture also includes panels arranged circumferentially around the structural center portion. The panels are connected to the interconnecting ring at the connection points. The panels are arranged at angles that are designed to dampen sound waves, and are constructed from material that further dampens sound waves coming into contact therewith.

18 Claims, 19 Drawing Sheets

(51) Int. Cl.
*F21V 21/008* (2006.01)
*F21Y 115/10* (2016.01)

(56) References Cited

U.S. PATENT DOCUMENTS

| | | | | |
|---|---|---|---|---|
| 6,780,356 | B1 * | 8/2004 | Putt | B28C 5/381 264/162 |
| 9,038,326 | B2 | 5/2015 | Bergman et al. | |
| 9,163,402 | B2 | 10/2015 | Kabatsi et al. | |
| 9,469,998 | B1 | 10/2016 | Guevara et al. | |
| 9,506,249 | B2 | 11/2016 | Kabatsi et al. | |
| D777,944 | S | 1/2017 | Kilian et al. | |
| 2015/0366020 | A1 * | 12/2015 | Park | F21V 23/0442 362/234 |

OTHER PUBLICATIONS

Vapor Echo Cylinder (LX-VEC) date screen shoot (Year: 2013).*
Vapor Echo Cylinder (LX-VEC) installation instructions (Year: 2013).*
IP.com English translation of FR-2405427-A1 (Year: 1979).*

* cited by examiner

FELT ARRAY

CROSS-REFERENCE TO RELATED APPLICATIONS

This application claims the benefit of and priority to U.S. Provisional Patent Application Ser. No. 62/508,529, filed on May 19, 2017, entitled "FELT ARRAY" which application is incorporated herein by reference in its entirety.

BACKGROUND

Light fixtures come in many different varieties and styles. Some light fixtures are relatively simple, and provide little more than a housing for a light bulb. Other light fixtures are ornate, with multi-faceted designs. Some light fixtures are designed for commercial settings, while others are designed for residential use. Coverings for light fixtures are often made of plastic, metal or glass. Glass light fixtures tend to irradiate most of the light generated by the light source, while other fixtures made of metal or plastic may diffuse or direct the light in specific directions. Light fixtures are used in nearly every room in a building and, as a result, many different configurations of styles and materials are available.

Many rooms, especially in commercial settings, are quite large and require many different light fixtures to provide sufficient light to the room. These large rooms also bring other challenges including reverberation. Indeed, conference rooms and other large gathering rooms may suffer from high levels of sound reverberation, which causes voices and other sounds to appear muddled and unclear. This reverberation, even in small amounts, can cause listeners to tune out presenters, speakers or performers, as the lack of tonal clarity makes listening more labor intensive for the audience.

BRIEF SUMMARY

Embodiments described herein are generally directed to a sound-dampening light fixture. In one embodiment, the sound-dampening light fixture includes the following: a structural center portion that includes a housing for a light source, and at least one interconnecting ring that includes connection points for connecting panels to the interconnecting ring. The sound-dampening light fixture also includes panels arranged circumferentially around the structural center portion. The panels are connected to the interconnecting ring at the connection points. The panels are arranged at angles that are designed to dampen sound waves, and are constructed from material that further dampens sound waves coming into contact therewith.

In another embodiment, a method is provided manufacturing a sound-dampening light fixture. The method includes providing a structural center portion that includes a housing for a light source. The method also includes positioning at least one interconnecting ring around the structural center portion, where the interconnecting ring has multiple connection points for connecting panels to the interconnecting ring. Still further, the method includes connecting the panels circumferentially around the structural center portion at the connection points of the interconnecting ring, where the panels are arranged at angles that are designed to dampen sound waves, and where at least parts of the panels are constructed from sound-dampening material.

In another embodiment, a sound-dampening lighting apparatus is provided. The sound-dampening lighting apparatus includes an interior frame that provides structural support for external panels, as well as a hanging apparatus connected to the interior frame. Still further, the lighting apparatus includes an interconnecting ring that has connection points for connecting the external panels to the interior frame, where the panels extend laterally away from the interior frame. The lighting apparatus also includes lights mounted on the interior frame that are programmable to cast light in a variety of directions. A controller is also included which is electrically connected to the lights. The controller is configured to direct light from the lights in various directions as specified by a user or control routine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be apparent to one of ordinary skill in the art from the description, or may be learned by the practice of the teachings herein. Features and advantages of embodiments described herein may be realized and obtained by means of the instruments and combinations particularly pointed out in the appended claims. Features of the embodiments described herein will become more fully apparent from the following description and appended claims.

BRIEF DESCRIPTION OF THE DRAWINGS

To further clarify the above and other features of the embodiments described herein, a more particular description will be rendered by reference to the appended drawings. It is appreciated that these drawings depict only examples of the embodiments described herein and are therefore not to be considered limiting of its scope. The embodiments will be described and explained with additional specificity and detail through the use of the accompanying drawings in which.

DETAILED DESCRIPTION

As noted above, the embodiments described herein are generally directed to a sound-dampening light fixture. In one embodiment, the sound-dampening light fixture includes the following: a structural center portion that includes a housing for a light source, and at least one interconnecting ring that includes connection points for connecting panels to the interconnecting ring. The sound-dampening light fixture also includes panels arranged circumferentially around the structural center portion. The panels are connected to the interconnecting ring at the connection points. The panels are arranged at angles that are designed to dampen sound waves, and are constructed from material that further dampens sound waves coming into contact therewith.

In another embodiment, a method is provided manufacturing a sound-dampening light fixture. The method includes providing a structural center portion that includes a housing for a light source. The method also includes positioning at least one interconnecting ring around the structural center portion, where the interconnecting ring has multiple connection points for connecting panels to the interconnecting ring. Still further, the method includes connecting the panels circumferentially around the structural center portion at the connection points of the interconnecting ring, where the panels are arranged at angles that are designed to dampen sound waves, and where at least parts of the panels are constructed from sound-dampening material.

In another embodiment, a sound-dampening lighting apparatus is provided. The sound-dampening lighting apparatus includes an interior frame that provides structural support for external panels, as well as a hanging apparatus connected to the interior frame. Still further, the lighting apparatus includes an interconnecting ring that has connection points for connecting the external panels to the interior frame, where the panels extend laterally away from the interior frame. The lighting apparatus also includes lights mounted on the interior frame that are programmable to cast light in a variety of directions. A controller is also included which is electrically connected to the lights. The controller is configured to direct light from the lights in various directions as specified by a user or control routine.

Figure 1A:
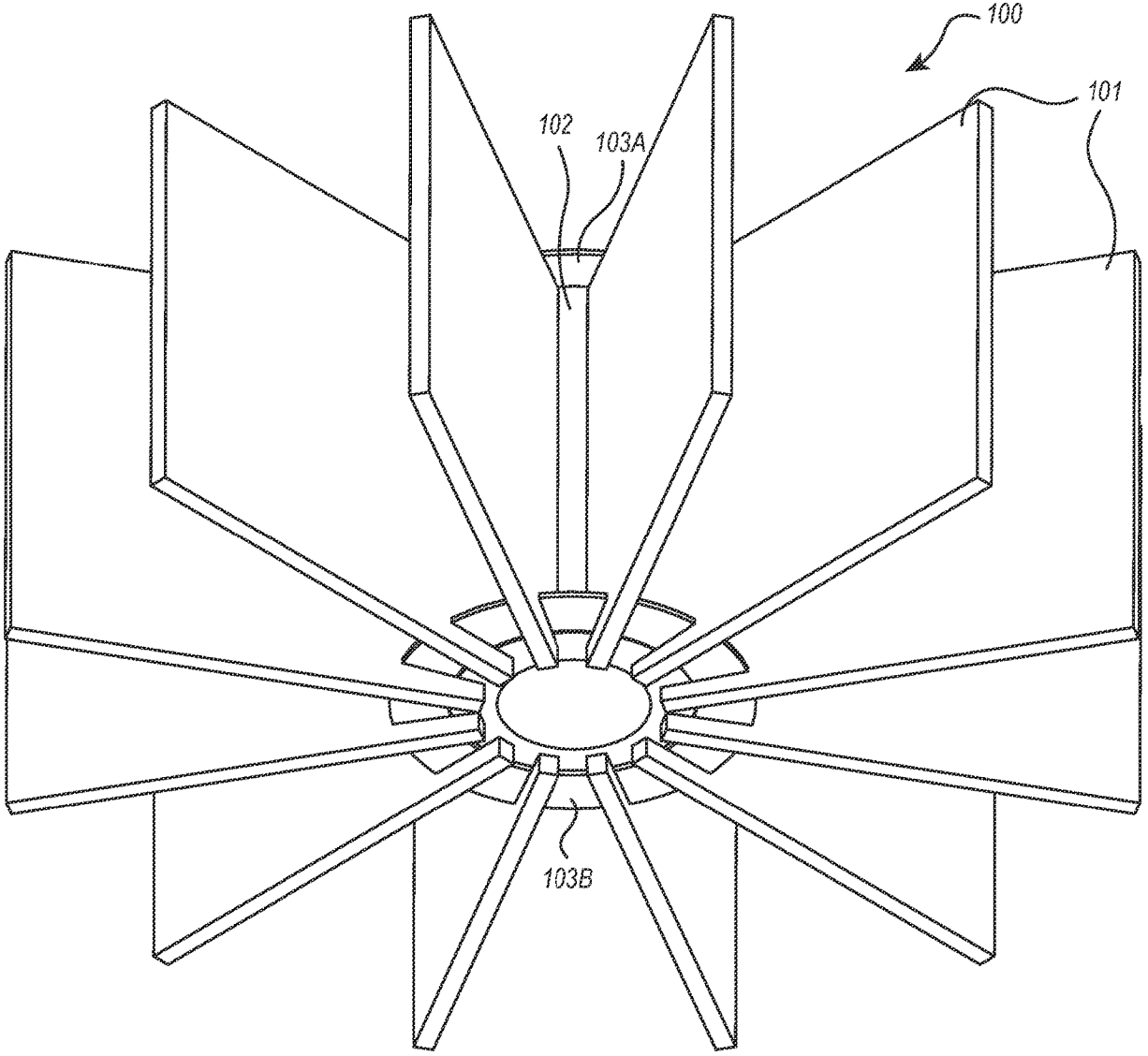
FIG. 1A illustrates a bottom perspective view of a sound-dampening light fixture.

As shown in FIG. 1A, a sound-dampening light fixture 100 may include multiple different panels 101 that are arranged around a structural center portion 102. The panels 101 may be formed in substantially any shape or size, and may be arranged tightly together, or may be spaced apart. Each panel may have connecting portions 104-106 (shown in FIGS. 2A and 2B) that connect to an interconnecting ring 103 of the sound-dampening light fixture 100. In some cases, a single interconnecting ring may be used (103A or 103B), or in other cases, multiple interconnecting rings may be used (e.g. 103A and 103B). The connecting portions 104 may include features such as grooves that allow the panels to be snap-fit to the interconnecting ring 103. The connecting portions 104 on the panels may include snap connectors, tie connectors, interlocking connectors, magnetic connectors or other types of semi-permanent or permanent connectors.

The panels 101 may be constructed using one or more materials that are designed to dampen sound. For instance, in one embodiment, felted polyethylene terephthalate (PET) fibers may be used. PET fibers may be manufactured and felted using a variety of known felting processes. The resulting felted PET fibers can be press-formed or heat-formed into rigid structures, such as the panels shown in the sound-dampening light fixture of FIG. 1. The panels 101 may be relatively thin (e.g. 1/16"-1/8") to relatively thick (1/2"-3/4"), and may be made of a single material or a combination of materials. Indeed, some panels may include interior portions that are metal or plastic, which are then surrounded by a sound-dampening material such as felted PET. In other cases, the entire panel may be constructed using felted PET. Optionally, the felted PET portions may be composed of recycled PET.

Figure 2A:
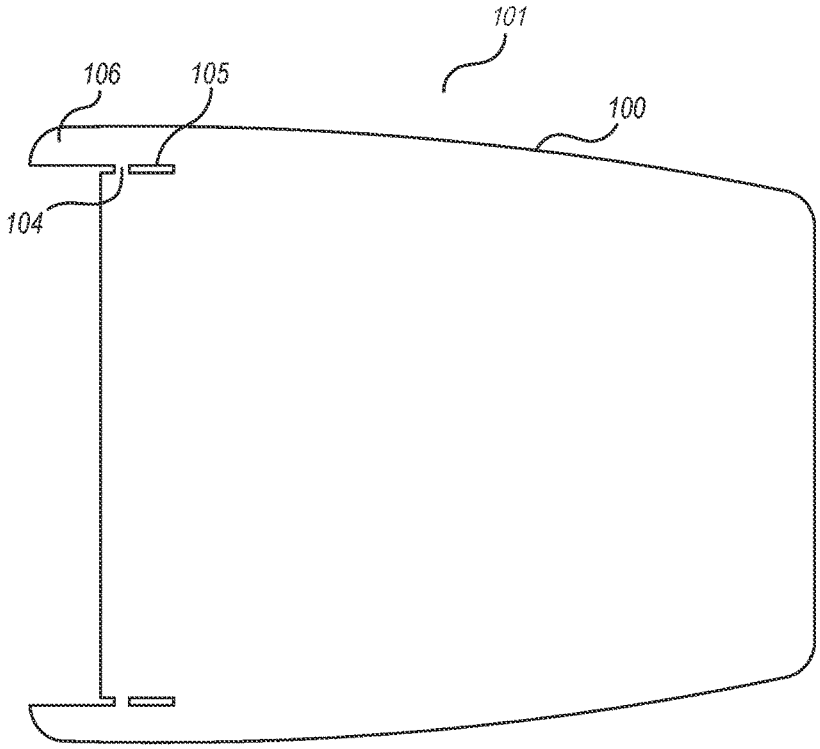
FIG. 2A illustrates a side facing view of a single panel.

The panels may be shaped in a specified manner that dampens sound. For instance, as shown in FIG. 1A, the panels 101 may be shaped like rectangles or squares, with defined corners and edges. In FIG. 2A, the panel 101 is shaped like a fin, having rounded edges. Many shapes and sizes may be used, and each panel on a given fixture may be the same or a different shape and size. The shapes may be engineered to reduce echoes and reverberation within a room.

In some cases, for example, the shape and size of the panels may be based on the size and shape of the room into which the panels (and the corresponding light fixture) are to be placed. Some sizes and shapes of panels may be more conducive to reducing echoes and reverberations in larger or smaller rooms, crowded or empty rooms, rooms with large amounts of glass or other highly reflective materials, etc. Accordingly, each sound-dampening light fixture may be specifically designed for a specific room or environment. The shape, size and thickness of each panel may be changed to accommodate different room types.

Figure 1B:
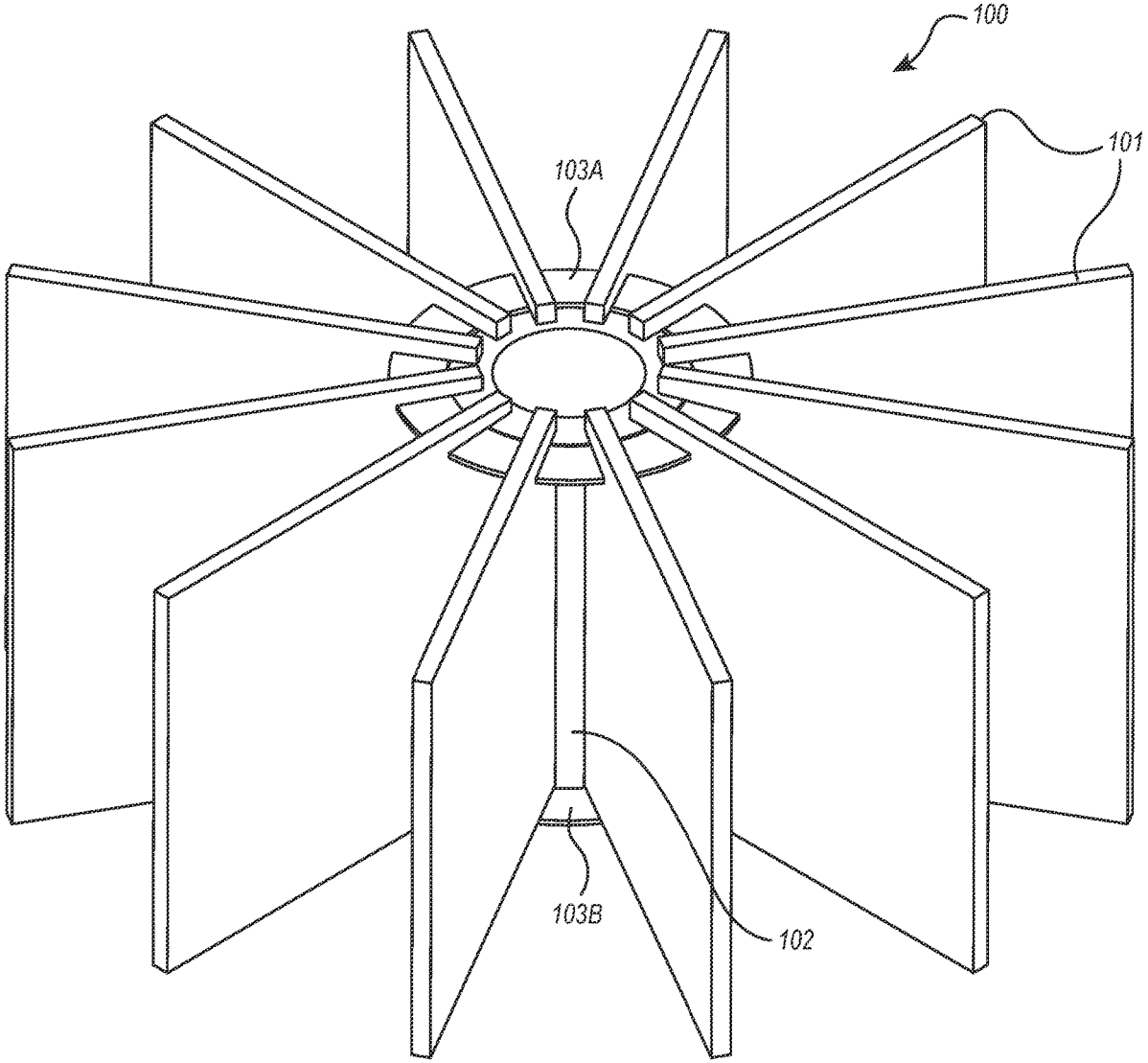
FIG. 1B illustrates a top perspective view of a sound-dampening light fixture.
Figure 1C:
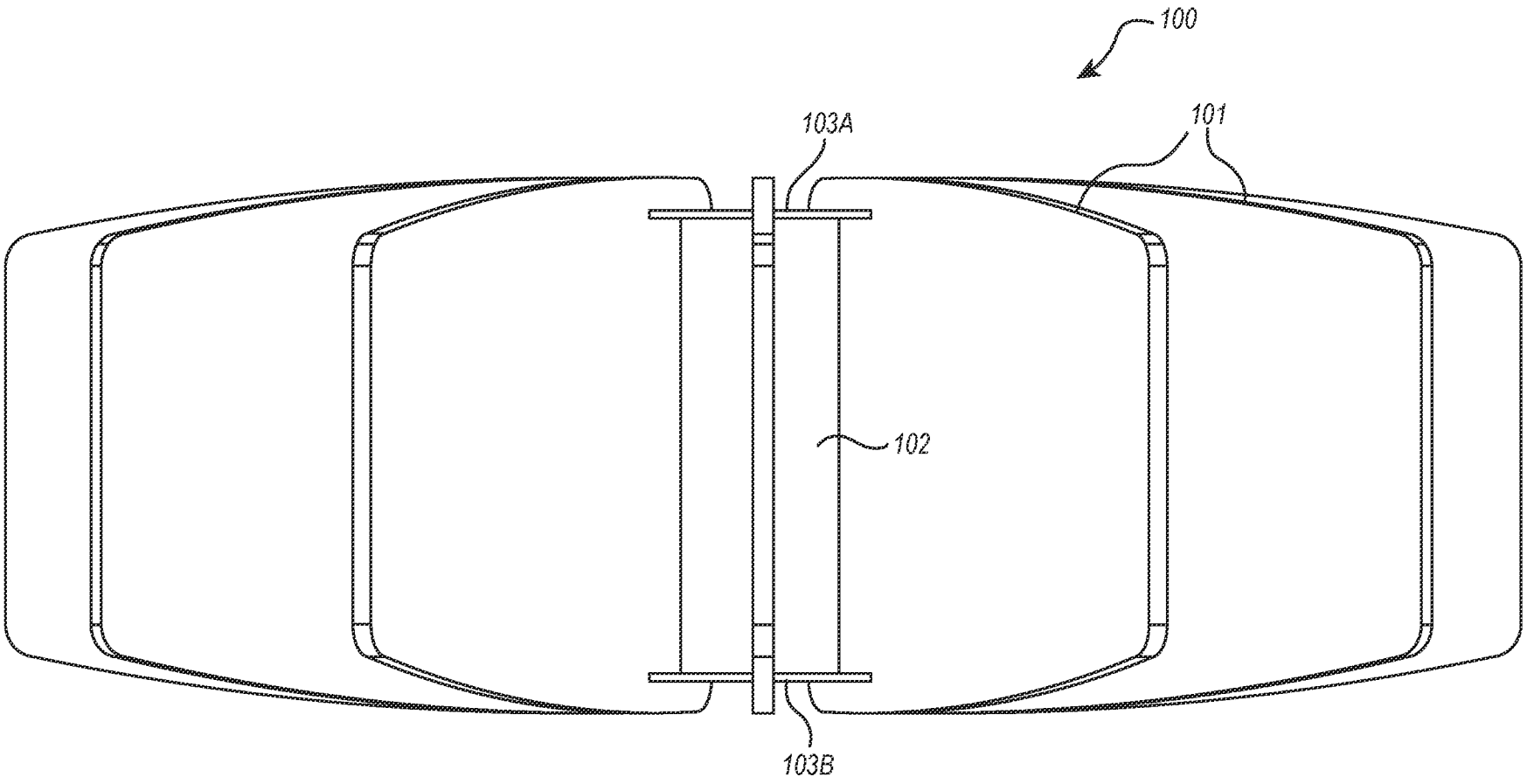
FIG. 1C illustrates a facing view of a sound-dampening light fixture.
Figure 1D:
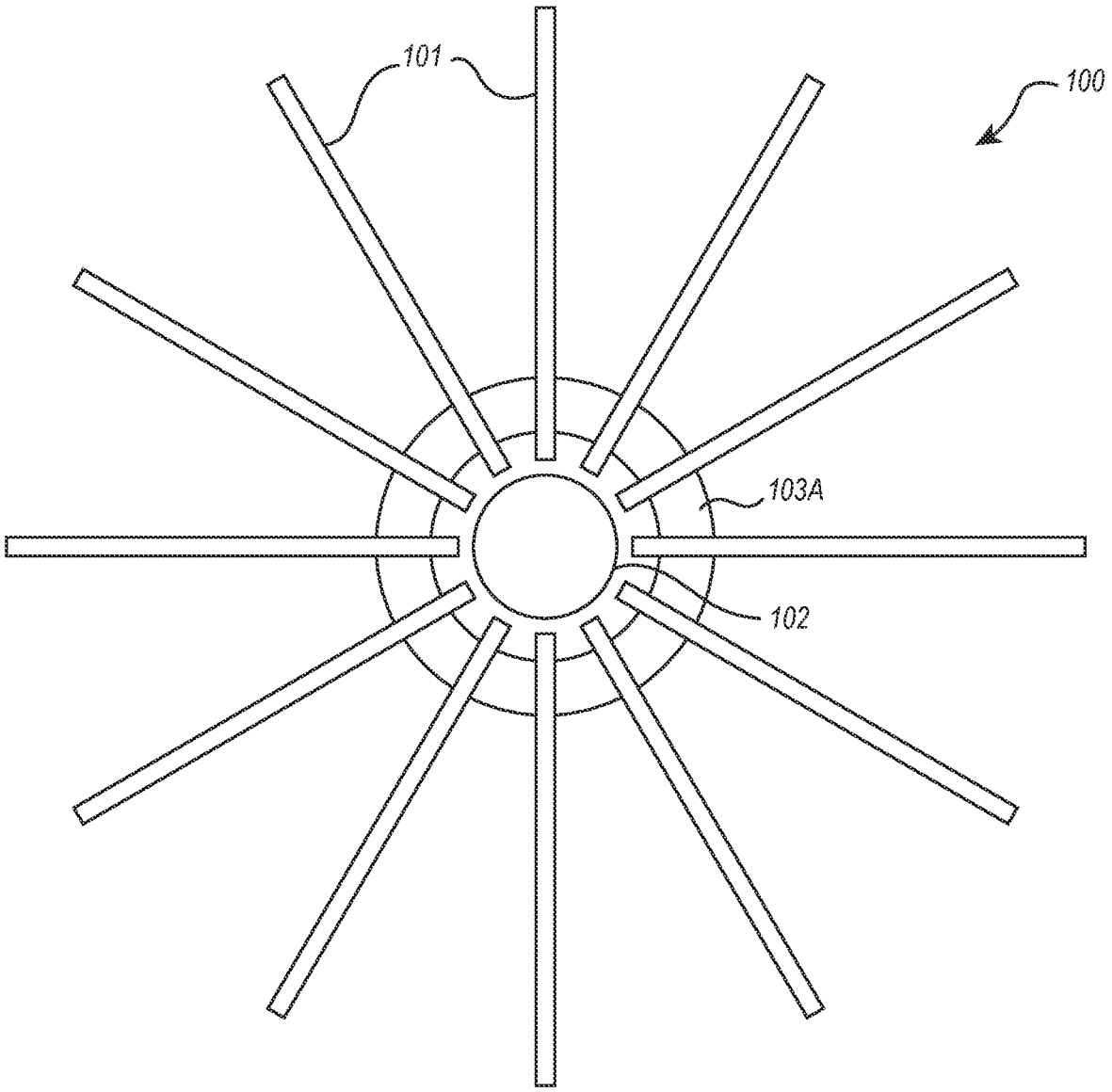
FIG. 1D illustrates a top view of a sound-dampening light fixture.

The sound-dampening light fixture 100 may be hung by itself, or may be connected to other sound-dampening light fixtures (as described further below with regard to FIGS. 5A-6C). FIGS. 1A-1D illustrate a single sound-dampening light fixture, shown from different perspectives. FIG. 1A, for example, shows a bottom perspective view of a sound-dampening light fixture, while FIG. 1B shows a top perspective view of the light fixture 100. FIGS. 1C and 1D illustrate front facing and top views, respectively. Each of these views illustrates the sound-dampening light fixture 100 having 12 panels. It will be recognized, however, that substantially any number of panels may be used, and that the interconnecting rings 103A/B may be designed to hold more panels than are actually used. For example, if the interconnecting rings 103A/B were designed to hold 15 panels 101, a user may use 10 of the slots, and leave the other five vacant. The 10 used slots may be aligned with the geometry of the room or environment of the space into which it is installed, thereby providing for enhanced sound-dampening capabilities.

Figure 2B:
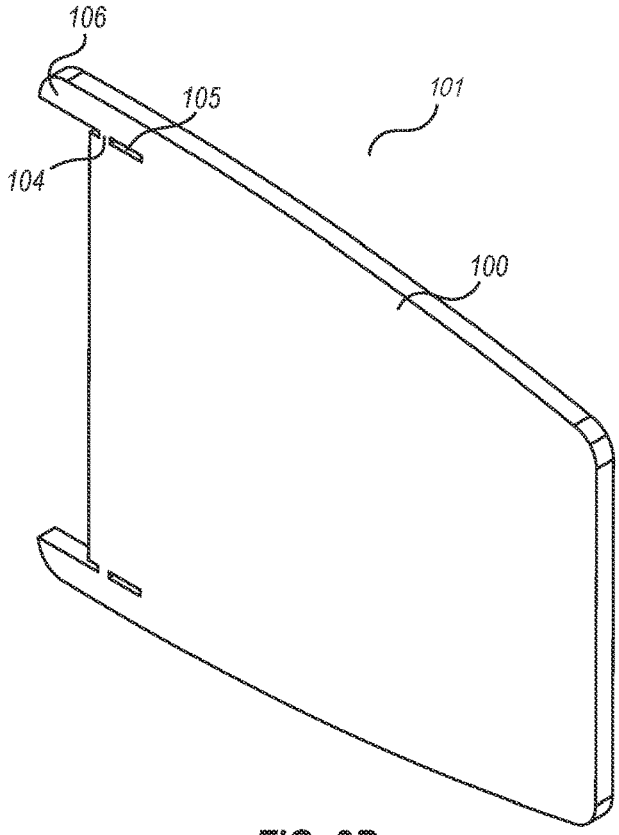
FIG. 2B illustrates a front perspective view of the panel.

FIGS. 2A and 2B illustrate side and perspective views of a panel 101. In these embodiments, the panel 101 includes connecting portions 104-106. Connecting portion 104 may be a tab or interstitial element that lies between an inner edge of the panel and a notch 105. The notch 105 may be designed to allow a snap-fit connector (e.g. 107) of the interconnecting ring 103 to snap into the notch, while the connecting portion 104 holds the snap-fit connector in place, locked tight to the panel. A protruding element 106 may stick out from the inner end of the panel. This protruding element 106 may rest against the top or bottom surfaces of the respective interconnecting rings 103A/B. The protruding element 106 may serve to vertically align the panel 101 with the structural center portion 102, and may hold the panel in place once attached to the interconnecting ring.

Figure 3A:
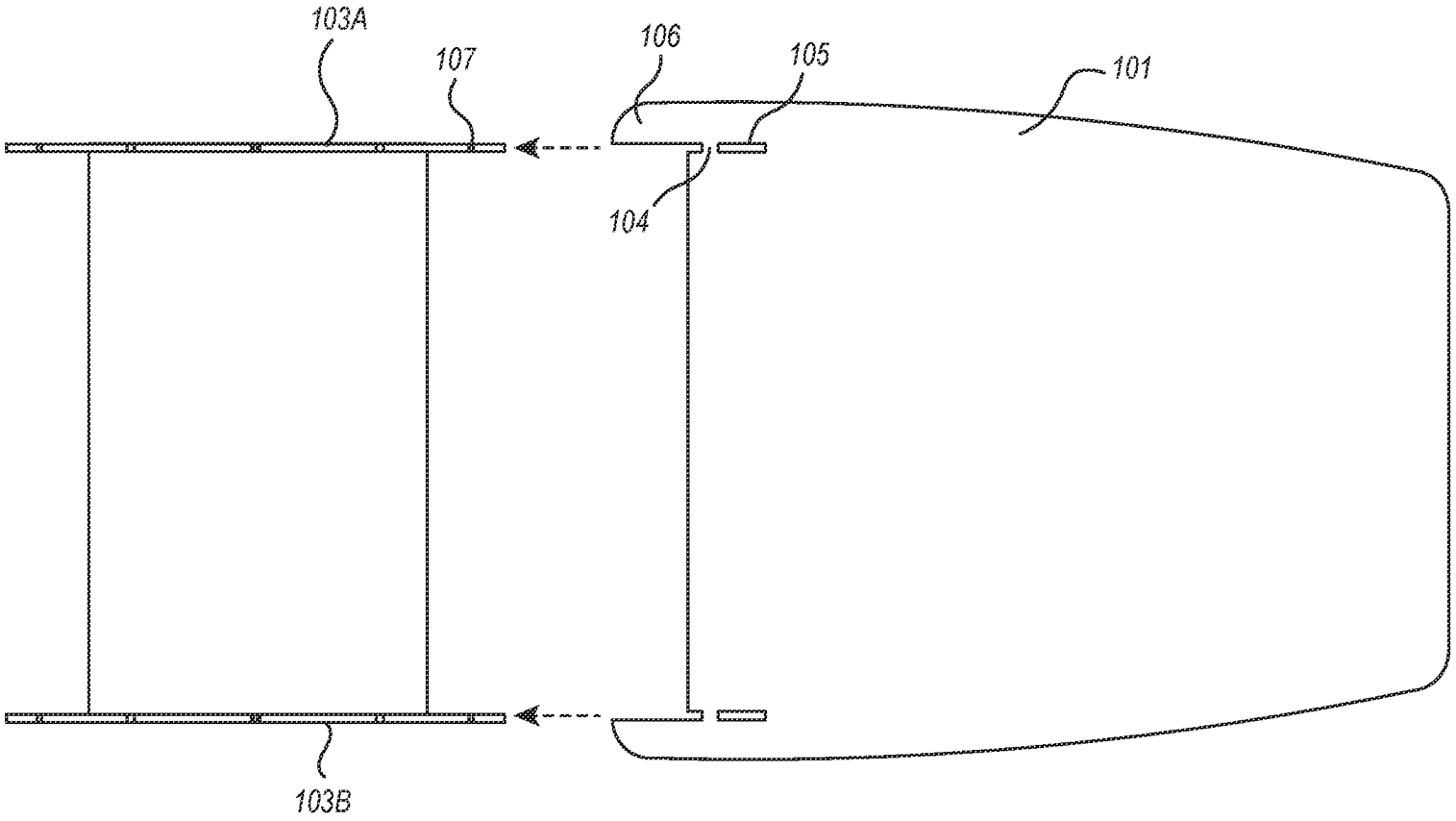
FIG. 3A illustrates a side facing view of a single panel being slid into contact with an interconnecting ring.
Figure 3B:
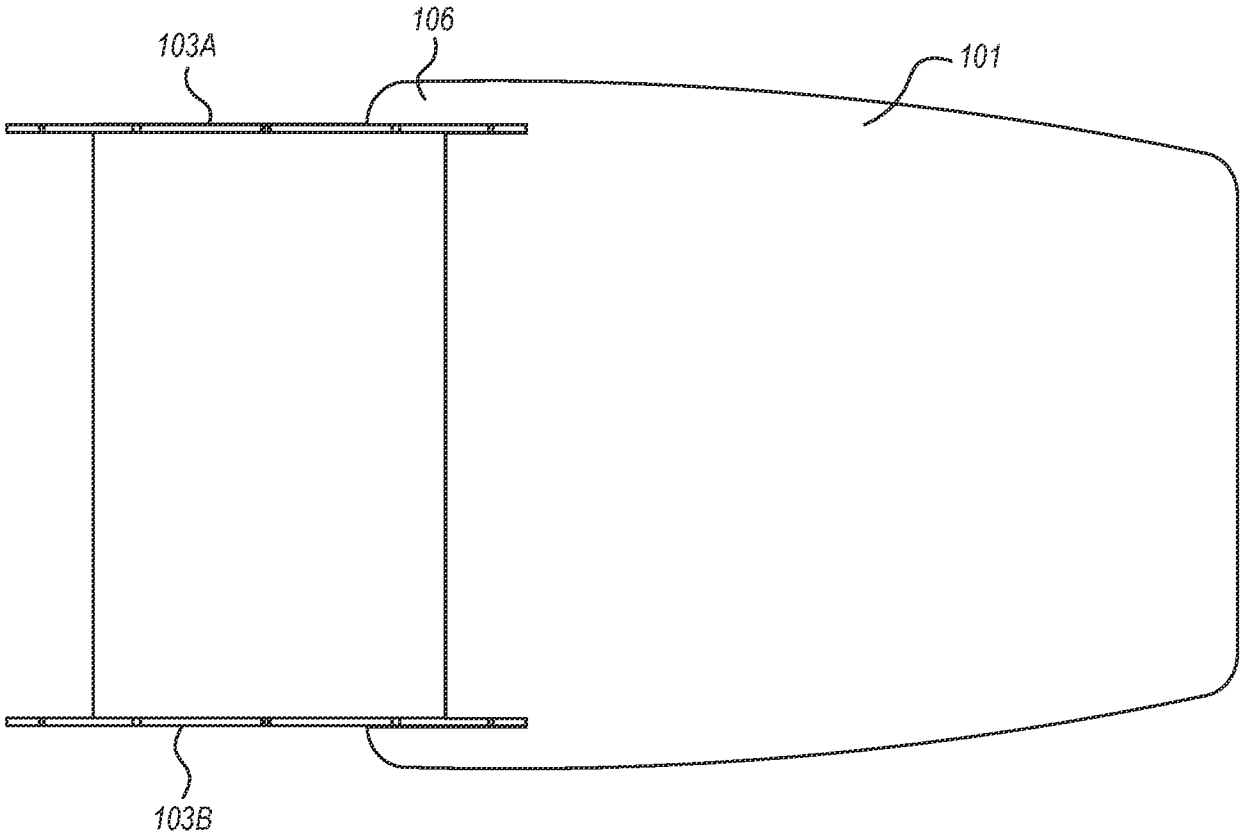
FIG. 3B illustrates a side facing view of the panel in contact with the interconnecting ring.

As shown in FIGS. 3A and 3B, the panel 101 may be attached to the interconnecting rings 103A/B via the connecting portion 104 and the notch 105. The snap-fit connector 107 of the interconnecting ring 103 slides over the connecting portion 104 and into the notch 105. The connecting portion and notch then work cooperatively to hold the panel in place. Other types of connections may also be used including hooks, screws, nails, rivets, clasps, tongue and groove fittings, or any other type of permanent or semi-permanent fastening.

Figure 3C:
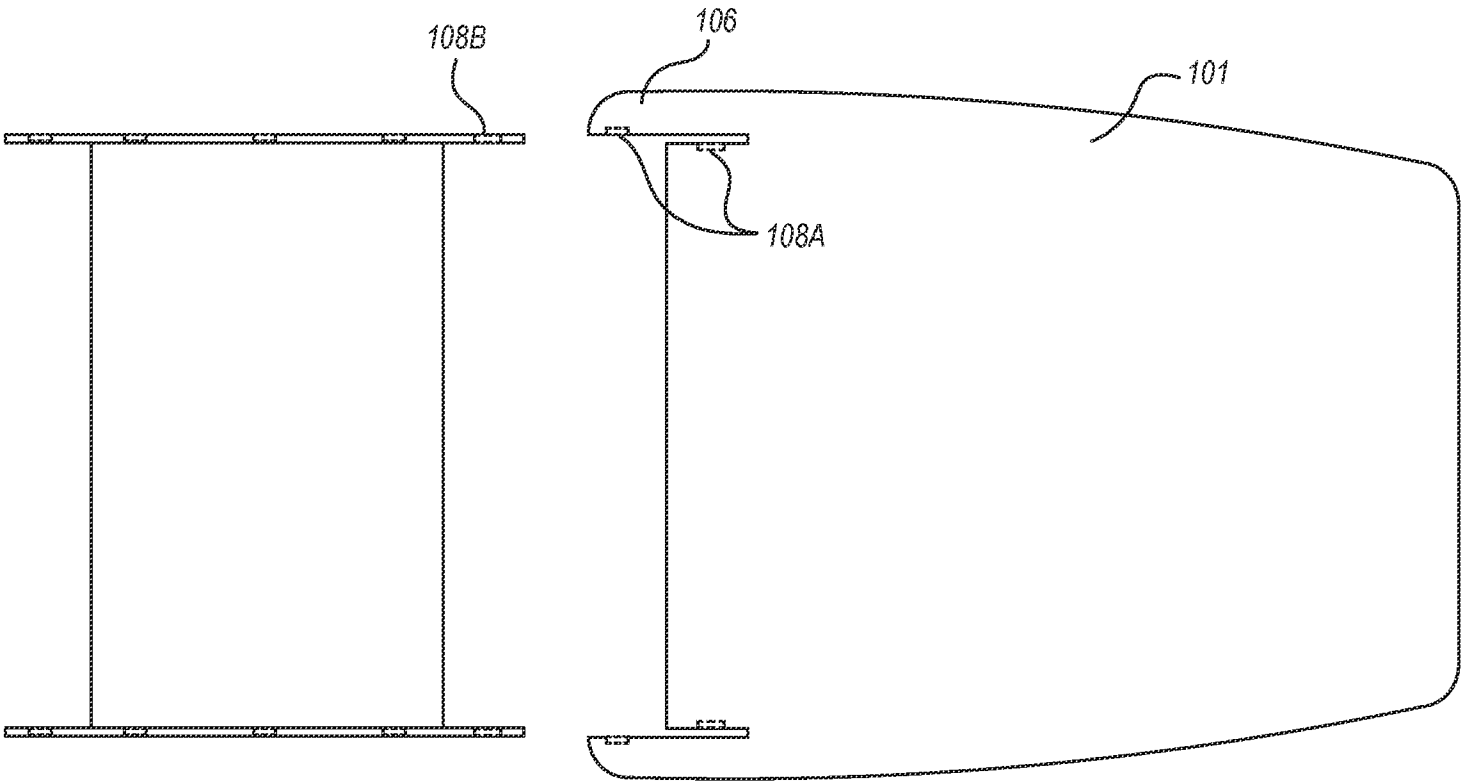
FIG. 3C illustrates a side facing view in which the panel and the interconnecting ring include magnets for fastening.

As shown in FIG. 3C, the fasteners can be magnets 108A and 108B. Indeed, in the embodiment of FIG. 3C, the panel has magnets 108A, and the interconnecting ring 103A has one or more corresponding magnets 108B. These magnets are oppositely charged so they attract. The magnets may be sized appropriately to hold the panel 101 in place, while still allowing it to be separated if needed. For example, if the sound-dampening light fixture 100 is installed in a given room, and the acoustics are not improved, different shapes and sizes of panels may be easily swapped in and out using the magnetic connections. Once the correct sizes, shapes and number of panels are matched to the room's characteristics, an appropriate level of sound dampening may be provided.

Figure 4A:
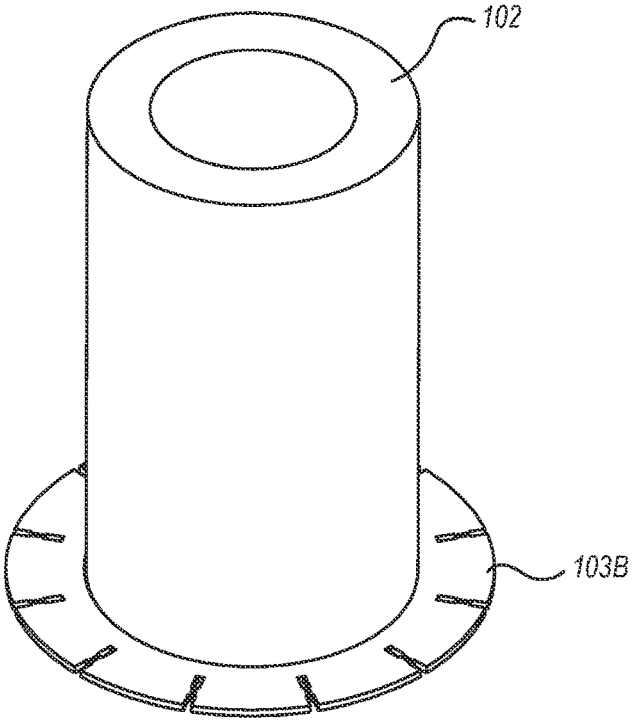
FIG. 4A illustrates an embodiment with a single interconnecting ring around a base structural member.
Figure 4B:
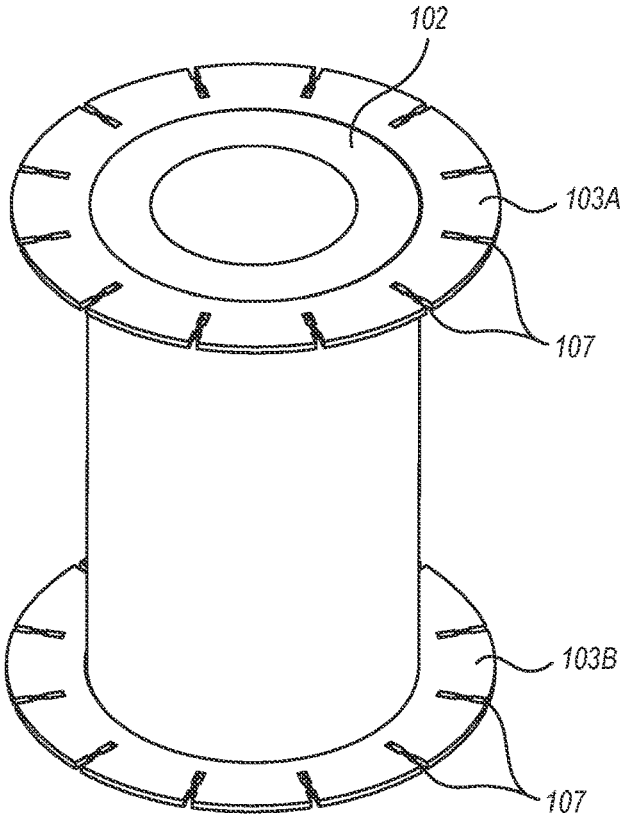
FIG. 4B illustrates an embodiment with multiple interconnecting rings around the base structural member.

FIGS. 4A-4D illustrate embodiments of the structural center portion 102, interconnecting rings 103A/B, and different light sources 109A and 109B. In FIG. 4A, a structural center portion 102 is illustrated as a cylinder. It will be recognized that the structural center portion 102 may be substantially any shape or size, including square, rectangular, triangular, circular or other shape. The interconnecting rings may be correspondingly shaped to fit around the structural center portion, depending on its shape. Thus, the interconnecting rings 103 may be square for square-shaped structural center portions. FIG. 4B illustrates an embodiment in which two interconnecting rings are used, although it will be understood that three, four, or more interconnecting rings may be used. In still other embodiments, the panels may be snap-fit, screwed, riveted, glued or magnetically attached directly to the structural center portion 102. In such cases, interconnecting rings would not be used.

Figure 4C:
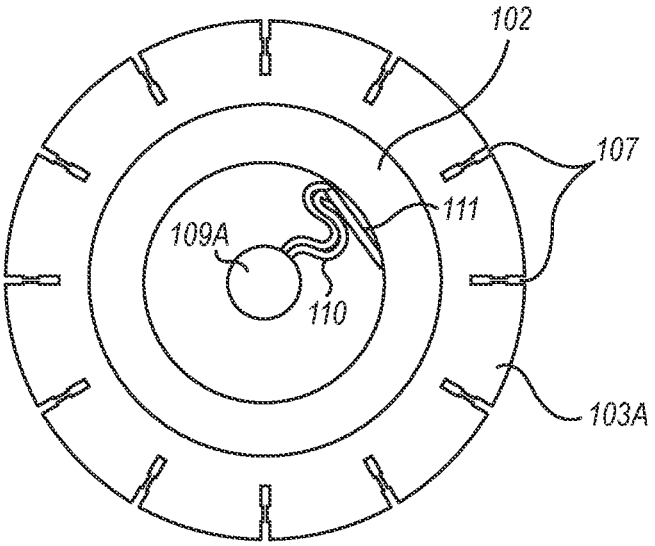
FIG. 4C illustrates a top view of the base structural member and interconnecting rings, along with a light source.

FIG. 4C illustrates a top view of an embodiment in which a light source 109A is mounted within the structural center portion 102. The light source 109 may be an incandescent or LED light bulb, LED light strip (as in FIG. 4D), or other type of light source. The light source 109 may be attached to a controller 111 via wiring 110. The controller 111 may be configured to control the light source, including controlling the intensity of the light, as well as the directionality of the light. In some cases, for example, the light source may be directed to shine light upward, while in other cases the light is to be shone downward. In still other cases, the light is to be shone in other angular directions, or in both upward and downward directions. In this manner, a user may have full control of both the lighting and acoustics in a room, using a single sound-dampening lighting apparatus.

FIGS. 5A-6C illustrate embodiments in which multiple sound-dampening light fixtures are connected to each other via linking members 201. In some embodiments, the linking members 201 are designed to fit into a slot where a panel 101 would normally reside. Thus, the linking members 201 may connect using snap connectors (or other types of connectors) that attach to corresponding connection 107 in the interconnecting members 103. In other cases, the linking members are more permanently attached to the structural center portion 102 (e.g. using glue, grommets or screws), while the panels remain interchangeable.

In embodiments where linking members 201 and panels 101 are all interchangeable, a user may be able to design a large collective fixture (e.g. 200A) made up of many different smaller fixtures (e.g. 100A-100E) that is tailored to the acoustics of a given room. The collective feature may include different lengths and sizes of linking members, as well as different shapes and sizes of panels, forming many variations in overall structure. Thus, regardless of how large or small the room, smaller light fixtures may be combined into larger collective fixtures that provide both sound-dampening and lighting functionality.

Figure 5A:
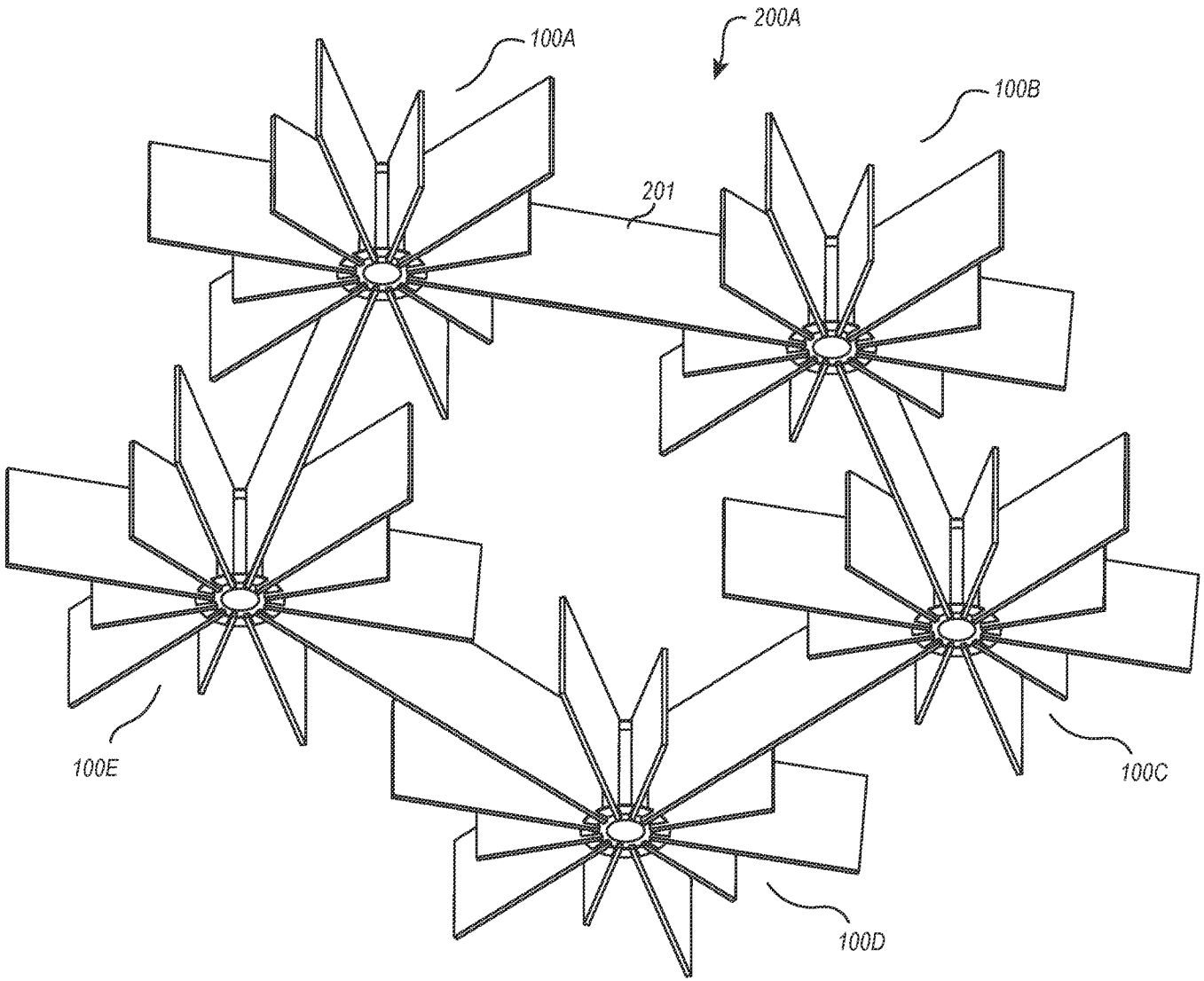
FIG. 5A illustrates a bottom perspective view of a sound-dampening light fixture that is linked to multiple other sound-dampening light fixtures in a generally pentagonal shape.
Figure 5B:
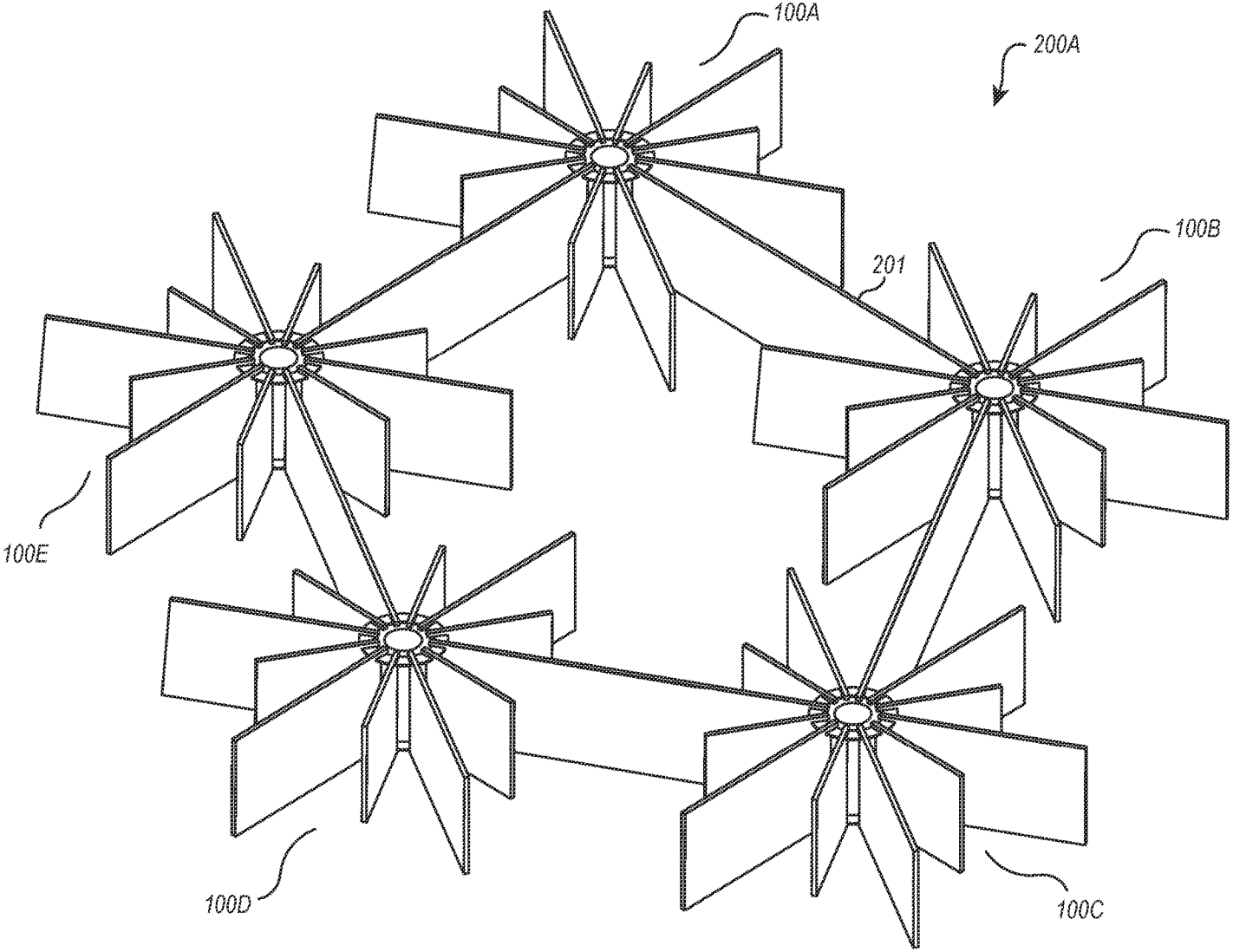
FIG. 5B illustrates a top perspective view of the sound-dampening light fixture linked to multiple other sound-dampening light fixtures in a generally pentagonal shape.

FIGS. 5A & 5B, for example, illustrate bottom and top perspective views of an embodiment in which five different light fixtures are shown (100A-100E), each being interconnected using a connecting member 201 to form a collective sound-dampening light fixture 200A. The five light fixtures, when combined, generally form a collective pentagonal light fixture. Each panel in the collective fixture is customizable in size or shape, or in the amount of sound-dampening material (e.g. felted PET). As shown in FIG. 5A, the interconnecting members 201 may connect to an interconnecting ring (or rings) of the sound-dampening light fixture. These interconnecting members 201 may also be composed of sound dampening material of varying thickness and size. As such, many different sound-dampening light fixtures may be interlinked, and may be tailored to fit the acoustics of any given room or space. Moreover, for large spaces, the collective light fixture may be expanded as needed to fill the entire room.

Figure 4D:
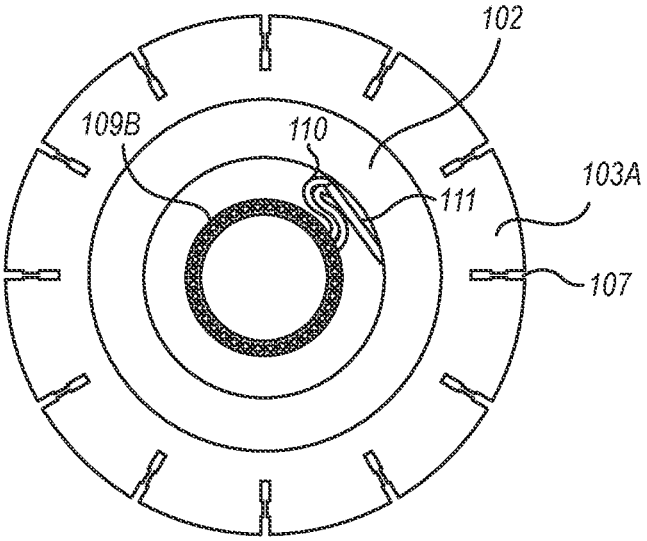
FIG. 4D illustrates a top view of the base structural member and interconnecting rings, along with an alternative light source.

In such cases where large collective sound-dampening light fixtures are used, each light source (e.g. 109A of FIG. 4C) may be controlled individually, or may be controlled collectively for the group of fixtures. Indeed, as illustrated in FIGS. 4C and 4D, each light source 109 may have its own controller 111 and wiring 110. The controllers may also be linked via wired connections or via wireless radio connections such as WiFi, Bluetooth, Zigbee, cellular or other radios. The controllers 111 may also be linked to a user's mobile device via an application that controls the lights including on or off status, directionality of the light source, intensity of the light source, or color (if color-changing lights are implemented). Thus, interlinked sound-dampening light fixtures act as both customizable, extensible lighting fixtures as well as acoustic management pieces. Additional sound-dampening light fixtures can be added to a room to add more light and ambience to the room, and at the same time reduce or manage echoes and reverberations.

In some embodiments, both the interconnecting members that connect the sound-dampening light fixtures together, as well as the panels on each of the fixtures, are constructed using the same sound-dampening material (e.g. felted PET). In other cases, the interconnecting members and the panels are constructed using different sound-dampening materials, or using different thicknesses or designs of sound-dampening materials to alter the acoustics in a given area. Moreover, some panels may have angular, protruding portions that are further designed to reduce reverberations in a room.

Figure 5C:
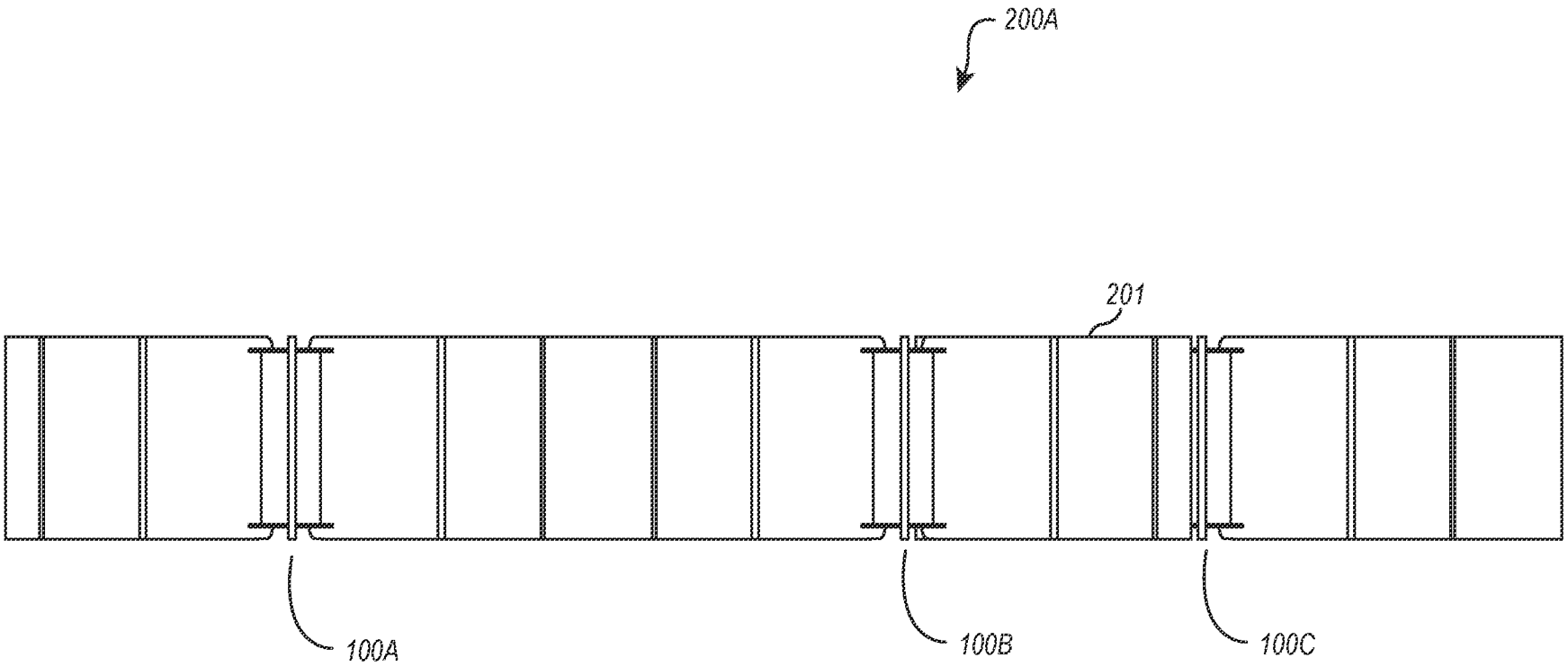
FIG. 5C illustrates a front facing view of the sound-dampening light fixture linked to multiple other sound-dampening light fixtures in a generally pentagonal shape.
Figure 5D:
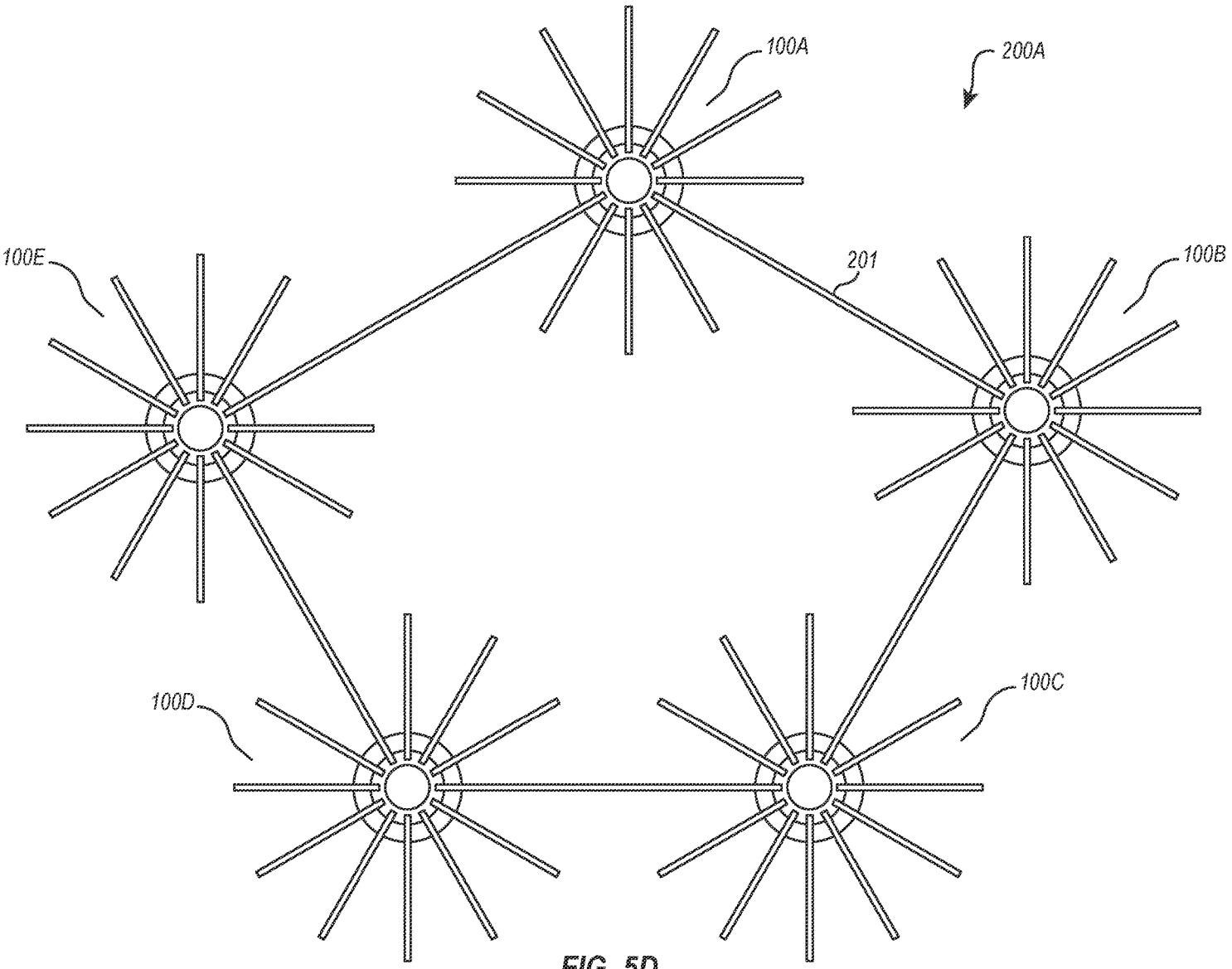
FIG. 5D illustrates a top view of the sound-dampening light fixture linked to multiple other sound-dampening light fixtures in a generally pentagonal shape.
Figure 6A:
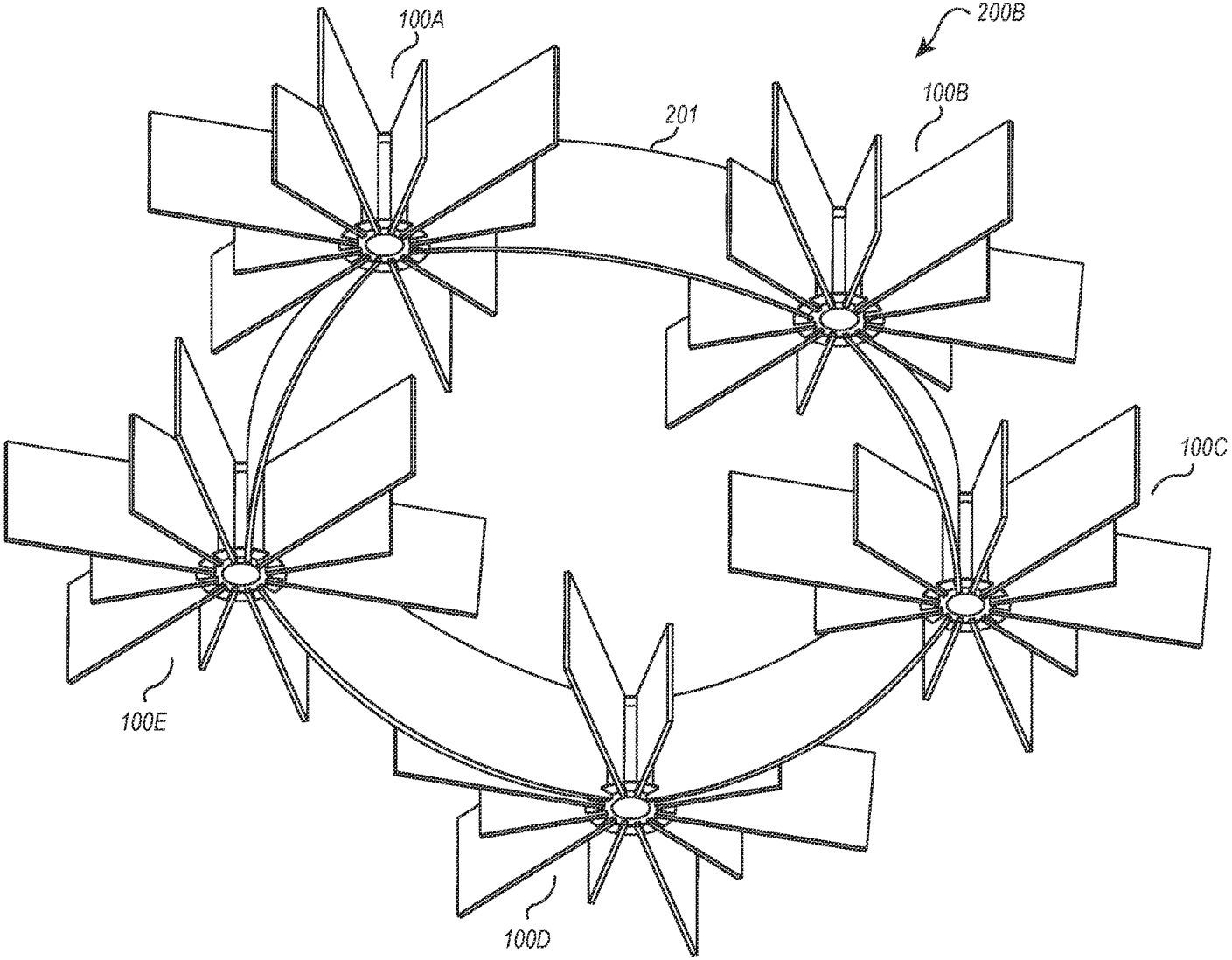
FIG. 6A illustrates a bottom perspective view of a sound-dampening light fixture that is linked to multiple other sound-dampening light fixtures in a generally circular shape.
Figure 6B:
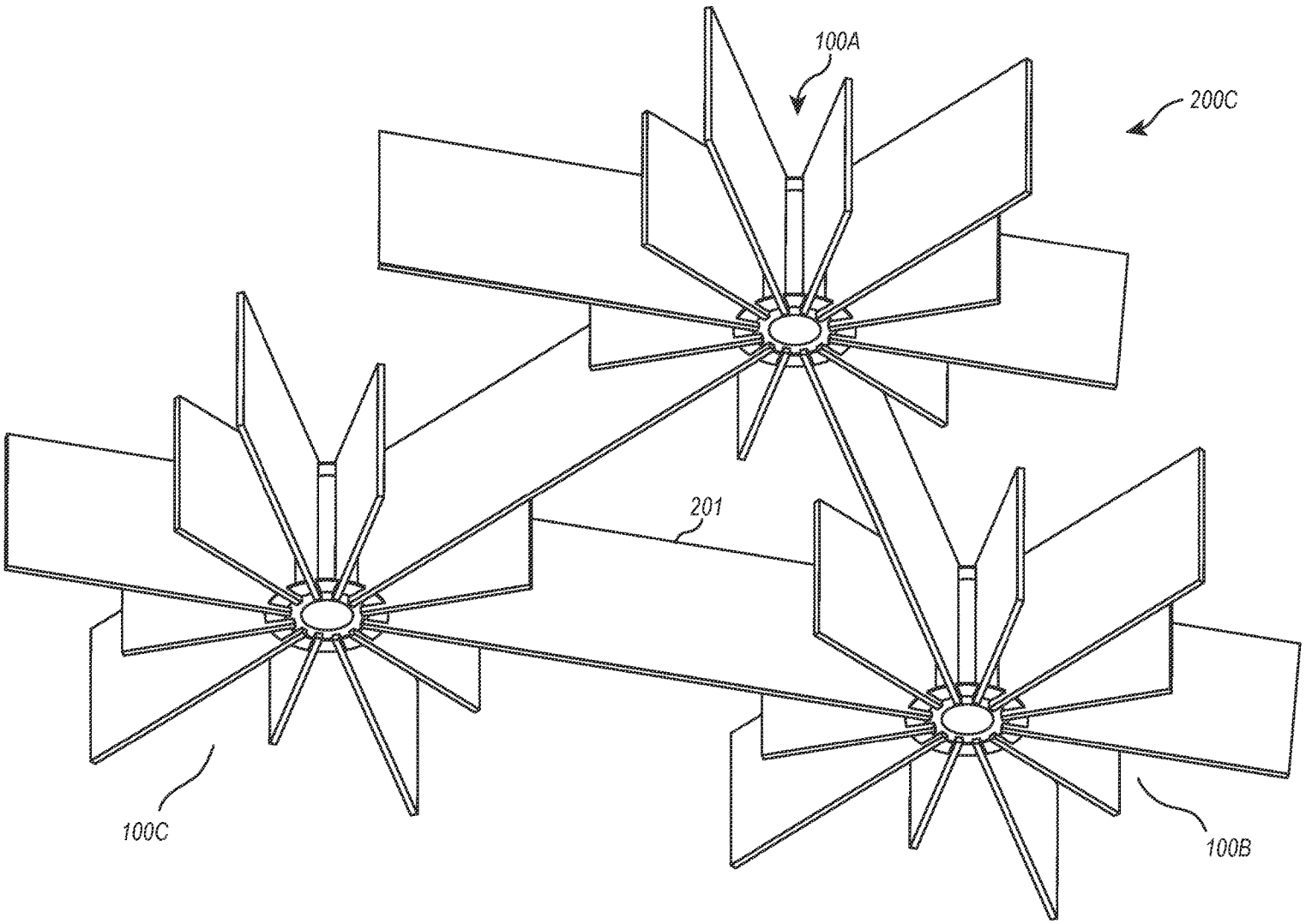
FIG. 6B illustrates a bottom perspective view of a sound-dampening light fixture that is linked to multiple other sound-dampening light fixtures in a generally triangular shape.
Figure 6C:
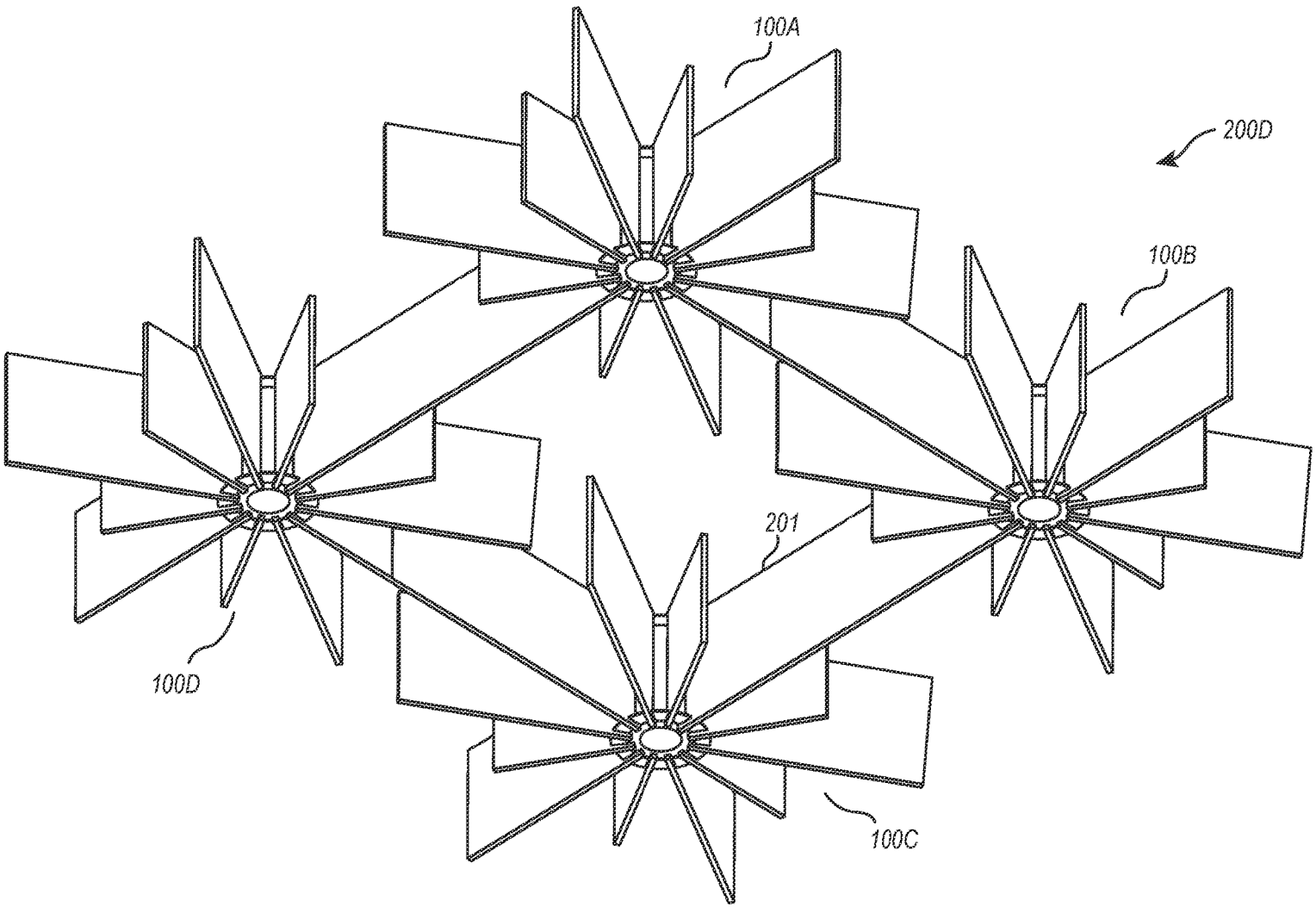
FIG. 6C illustrates a bottom perspective view of a sound-dampening light fixture that is linked to multiple other sound-dampening light fixtures in a generally square shape.

FIGS. 5C and 5D illustrate side and top views of the pentagonal collective light fixture 200A of FIGS. 5A and 5B. FIG. 6A illustrates an embodiment in which the interconnecting members 201 are rounded, such that the overall shape of the collective light fixture 200B, when using five individual fixtures (100A-100E), is circular. In similar fashion, FIG. 6B illustrates a collective light fixture 200C which is triangular in shape, while fixture 200D in FIG. 6C is square in shape. Thus, it can be seen that, using individual sound-dampening light fixtures such as fixture 100 of FIG. 1A, substantially any collective shape or design may be made. Furthermore, it should be understood that, in any given collective light fixture, some of the individual light fixtures may be higher or lower than the other fixtures. Although shown in FIGS. 5 and 6 as being hung the same height, the interconnecting members may be formed diagonally, and as such, may link to structural center portions that are hung in higher or lower positions.

Figure 7:
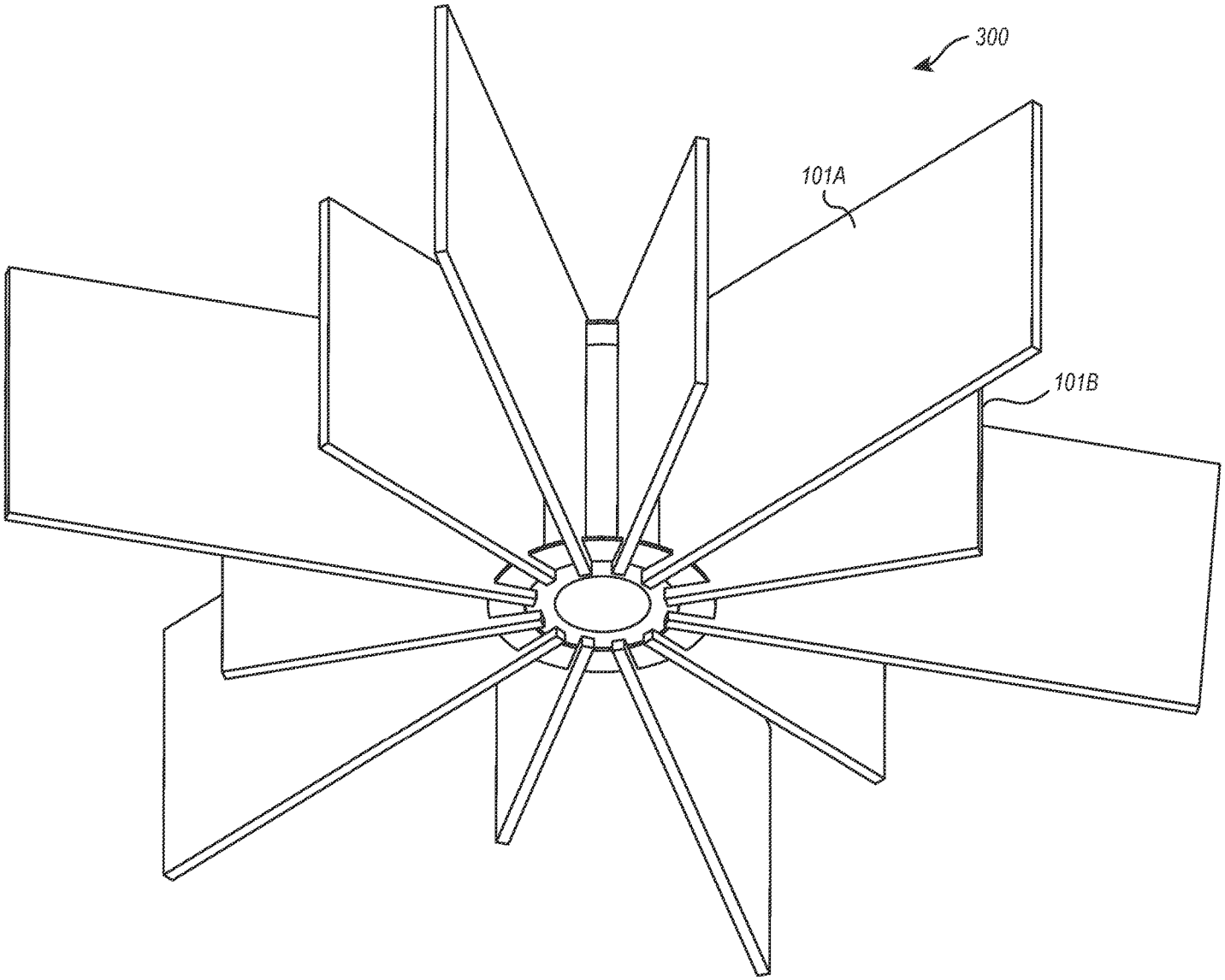
FIG. 7 illustrates a bottom perspective view of a sound-dampening light fixture that includes panels having different sizes and/or shapes.

FIG. 7 illustrates an embodiment in which a sound-dampening light fixture 300 includes panels having different sizes. Indeed, as can be seen, panel 101A is longer than panel 101B. Other panels may be longer or shorter still. This may have an additional dampening effect on sound waves that come into contact with the fixture. As with sound-dampening light fixture 100A, the structural center portion of sound-dampening light fixture 300 provides support for interconnecting rings, and further provides support for the panels attached to the rings (e.g. 101A and 101B). The structural center portion also houses various light sources light bulbs, LED strips, or other light source housings. Substantially any type of light source may be used within the structural center portion of the sound-dampening light fixture.

As with the embodiments described above, the structural center portion of sound-dampening light fixture 300 may be substantially cylindrical in shape. In other embodiments, the structural center portion may be rectangular, square, triangular, or may be an oblong or hand-formed shape. In such cases, the interconnecting rings may be correspondingly rectangular, square or triangle-shaped, or may be shaped to contour the oblong or hand-formed design. In this manner, it will be understood that although the interconnecting ring references a circular ring shape, it will be understood that the interconnecting ring may take a variety of different forms. Regardless of shape, the interconnecting ring allows panels to be connected to the structural center portion, whether removably or permanently.

In some cases, implementations of the invention as claimed, when actually used in rooms, have been empirically shown to reduce the in-room acoustic coefficient (i.e. the noise reduction coefficient or NRC) to nearly 1.0. On a scale where 0 is a perfect sound reflector (e.g. glass), and where 1.0 is a perfect sound absorber (e.g. an anechoic chamber), the sound-dampening light fixtures described herein can bring the NRC in a room to nearly 1.0, meaning that sounds do not echo or reverberate off of the sound-dampening light fixture. This high level of NRC is achieved despite the felted PET fibers having a substantially lower rating when tested alone (NRC was 0.65). The design of the panels, the fixture, and the combined collective fixture can have a great influence over how well sound is dampened in a given room.

In one specific embodiment, a sound-dampening light fixture (e.g. 100 of FIG. 1) includes the following: a structural center portion 102 that functions as a housing for a light source (e.g. 109A of FIG. 4C), one or more interconnecting rings (103A/B) that have connection points 104 for connecting panels 101 to the interconnecting ring(s). The panels 101 are arranged circumferentially around the structural center portion, and are connected to the interconnecting ring at the connection points. The panels are arranged at angles that are designed to dampen sound waves by absorbing a portion of sound energy. The panels 101 are constructed from a material that further dampens sound waves that come into contact with the panels.

Each room into which the sound-dampening light fixture 100 is to be installed is unique. Depending on whether the flooring has carpet or wood, or whether the walls have windows or doors, or other factors may dictate how conducive a room is to reverberations. The panels and the light fixture itself may be manufactured in a shape and design that is configured to dampen sound waves that come into contact with the light fixture. Rooms that are prone to reverberation (such as rooms with wood floors and multiple windows) may need a more aggressive design that dampens more sound, while other rooms (such as rooms with carpeted flooring and few windows) may not need as much sound dampening. In large rooms, a given sound-dampening light fixture may be connected to other sound-dampening light fixtures via interconnecting members that connect to connection points of the interconnecting rings. Each sound-dampening light fixture is modular, and can be connected to any number of other sound-dampening light fixtures.

Both the panels and the interconnecting member that connects the sound-dampening light fixture and the other sound-dampening light fixture(s) may be constructed using a sound-dampening material such as felted polyethylene terephthalate (PET) fibers. Each panel 101 connects to the center structural portion 102 either directly or via an interconnecting ring or set of rings. These interconnecting rings may be placed at the top, bottom, middle or other part of the structural center portions. The structural center portion itself may be constructed from a translucent material that allows light to be emitted. Thus, when a light source 109 is placed within the structural center portion, light can travel through the center portion. Different thicknesses and levels of opacity may be used to subdue the light and provide a customized ambience for the room.

For example, if an interior designer was designing the lighting and acoustics of a given room, the interior designer could select a specific type of material for the structural center portion. The designer could also link one or more sound-dampening light fixtures together in a formation that itself is designed to reduce sound vibrations, specifically for that room. Still further, the interior designer could use the controllers 111 in the light fixtures to specify where light is to be shone, at which intensity, and at which times. The interior designer (or operator of the room) may use an application to program the controllers, and the controllers may store the program in memory (e.g. in electronically erasable programmable memory (EEPROM)). Different programs may be stored and initialized by a user for different settings or functions. Using the light controller, a user can control many different properties of the light source, in real-time or in a pre-specified program.

Figure 8:
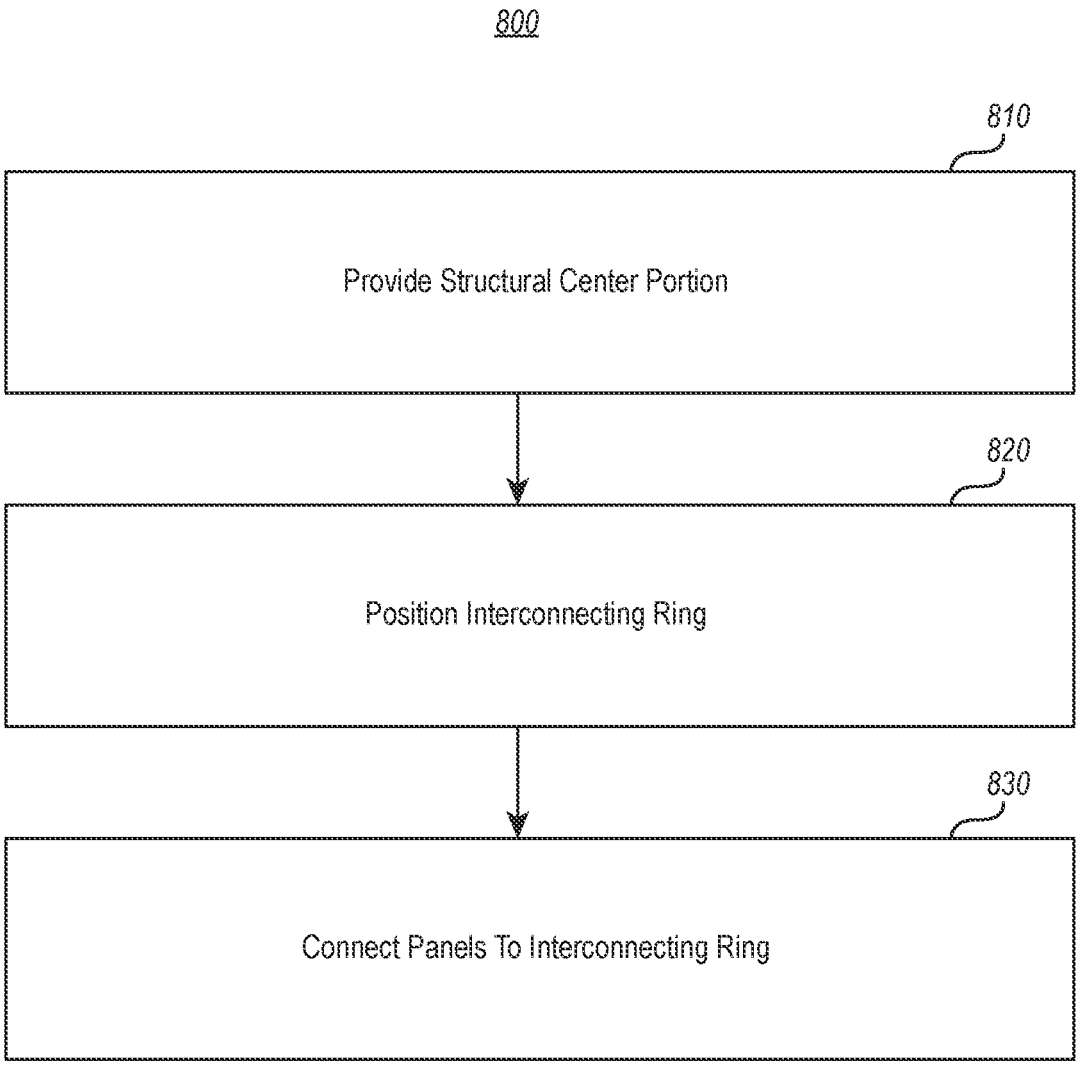
FIG. 8 illustrates a flowchart of a method for manufacturing a sound-dampening light fixture.

FIG. 8 illustrates a flow chart of a method 800 for manufacturing a sound-dampening light fixture. The method includes providing a structural center portion 102 that includes a housing for a light source (810), and positioning at least one interconnecting ring 103 around the structural center portion (820). The interconnecting ring has multiple connection points 104 for connecting one or more panels 101 to the interconnecting ring. The method also includes connecting the panels circumferentially around the structural center portion at the connection points of the interconnecting ring (830). The panels are arranged at angles that are designed to dampen sound waves. At least some parts of the panels are constructed from sound-dampening material.

Each manufactured sound-dampening light fixture is modular and may be combined with other sound-dampening light fixtures using interconnecting panels. A combined structure may be manufactured that includes multiple modular sound-dampening light fixtures linked together via these interconnecting sound-dampening panels. Each sound-dampening light fixture may be attached to a ceiling mount via a support line. In such cases, a first end of the support line is attached to the ceiling mount and a second end of the support line is attached to a mount on the structural center portion 102. The panels (including the interconnecting panels) may be attached to connection points of the interconnecting rings. These connection points may include snap-fit connections or magnetic connections where magnets embedded in the panels align with magnets embedded in the interconnecting rings.

In another specific example, a sound-dampening lighting apparatus is provided which includes the following: an interior frame (e.g. 102) that provides structural support for one or more external panels 101, a hanging apparatus connected to the interior frame, and an interconnecting ring 103 that includes various connection points 104 for connecting the external panels to the interior frame. The panels extend laterally away from the interior frame, as shown in fixture 300 of FIG. 7. The lighting apparatus in this example also includes lights (e.g. 109) mounted on the interior frame, where the lights are programmable to cast light in a variety of directions, and a controller electrically connected to the lights. The controller is configured to direct light emitting from the lights in specified directions or at specified intensities. The lights may be light emitting diode (LED) strips comprising multiple LED lights (as shown in FIG. 4D).

Each of the panels in the light fixture is interchangeable, allowing users to switch panels of different sizes and shapes to dampen sound in a specified manner. Indeed, as noted above, the lighting apparatus may be designed for a specified room according to specific room characteristics. As such, a user may be able to specify a minimum amount of light that is to be provided by the lighting apparatus and a minimum amount of sound dampening is provided for the room. Each fixture in a collective fixture may be individually controlled to provide lighting in a specific direction or intensity. Specific sizes and shapes of panels may also be used to tune the acoustics in a room. The sound-dampening baffle and lighting apparatus may be designed, for example, to dampen sounds between approximately 250 and 4,000 Hz, which is the frequency range typically used by human voices. This ensures that as people speak to each other within the room, their voices do not reverberate or echo, reducing the likelihood that any given person will be hard to listen to or understand.

Accordingly, sound-dampening light fixtures are described herein. The fixture's panels may be sized and shaped in a manner that reduces echoes and reverberations within a room, giving the room optimal acoustic properties for communication. Similarly, the arrangement and number of panels per fixture can be changed or adapted to reduce echoes and reverberations within a room. Still further, the number of fixtures in and the shape of an interconnected array of light fixtures can be varied accordingly to tune the acoustics of the room. Substantially any shape or size of array may be installed in a room, from a single fixture, to a plurality of interconnected fixtures that cover the entire ceiling and/or walls. The sound-dampening light fixtures provide the ability to cover the ceiling and/or walls with light sources that are aesthetically pleasing and acoustically functional, and still provide open access to the ceiling/wall and associated hardware such as sprinklers, smoke detectors, or other mechanical features.

The concepts and features described herein may be embodied in other specific forms without departing from their spirit or descriptive characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

We claim:

1. A sound-dampening light fixture, comprising:

a structural center portion that includes a housing for a light source;

at least one interconnecting ring that includes a plurality of connection points for connecting one or more panels to the interconnecting ring; and the one or more panels arranged circumferentially around the structural center portion, connected to the interconnecting ring at the connection points;

wherein:

the panels are arranged at angles that are designed to dampen sound waves, the panels being constructed from material that further dampens sound waves coming into contact therewith, and the panels are interchangeable, allowing users to switch panels of different sizes and shapes to dampen sound in a specified manner.

2. The sound-dampening light fixture of claim 1, wherein the one or more panels are manufactured in a shape that is designed to further dampen sound waves coming into contact with the light fixture.

3. The sound-dampening light fixture of claim 1, wherein the sound-dampening light fixture is connected to at least one other sound-dampening light fixture via an interconnecting member that connects to at least one connection point of the interconnecting ring.

4. The sound-dampening light fixture of claim 3, wherein the interconnecting member that connects the sound-dampening light fixture and the at least one other sound-dampening light fixture is constructed using the sound-dampening material.

5. The sound-dampening light fixture of claim 4, wherein the sound-dampening material comprises felted polyethylene terephthalate (PET) fibers.

6. The sound-dampening light fixture of claim 1, wherein the sound-dampening light fixture includes first and second interconnecting rings positioned at a top end and a bottom end of the structural center portion.

7. The sound-dampening light fixture of claim 6, wherein the one or more panels are connected to each of the first and second interconnecting rings at the top end and the bottom end of the structural center portion.

8. The sound-dampening light fixture of claim 1, wherein the structural center portion is constructed from a translucent material that allows light to be emitted therethrough.

9. The sound-dampening light fixture of claim 1, wherein a plurality of sound-dampening light fixtures are linked together in a formation that itself is designed to reduce sound vibrations.

10. The sound-dampening light fixture of claim 1, further comprising a light controller configured to control one or more properties of the light source.

11. The sound-dampening light fixture of claim 1, wherein the sound-dampening light fixture is designed to dampen sounds between approximately 250 and 4,000 Hz.

12. A method of manufacturing a sound-dampening light fixture, the method comprising:

providing a structural center portion that includes a housing for a light source;

positioning at least one interconnecting ring around the structural center portion, the interconnecting ring having a plurality of connection points for connecting one or more panels to the interconnecting ring; and connecting the one or more panels circumferentially around the structural center portion at the connection points of the interconnecting ring, the panels being arranged at angles that are designed to dampen sound waves;

wherein:

at least portions of the panels are constructed from sound-dampening material, and each manufactured sound-dampening light fixture is modular and is combinable with a plurality of other sound-dampening light fixtures using interconnecting panels.

13. The method of claim 12, wherein a combined structure is manufactured that includes a plurality of modular sound-dampening light fixtures linked together via interconnecting sound-dampening panels.

14. The method of claim 12, wherein the sound-dampening light fixture is attached to a ceiling mount via a support line, and wherein a first end of the support line is attached to the ceiling mount and a second end of the support line is attached to a mount on the structural center portion.

15. The method of claim 12, wherein the connection points of the interconnecting ring comprise snap-fit connections or magnetic connections where one or more magnets embedded in the panels align with one or more magnets embedded in the interconnecting ring.

16. A sound-dampening lighting apparatus, comprising:

an interior frame that provides structural support for one or more external panels, wherein the panels are interchangeable, allowing users to switch panels of different sizes and shapes to dampen sound in a specified manner;

a hanging apparatus connected to the interior frame;

an interconnecting ring that includes a plurality of connection points for connecting the one or more external panels to the interior frame, the panels extending laterally away from the interior frame;

one or more lights mounted on the interior frame, the one or more lights being programmable to cast light in a variety of directions; and a controller electrically connected to the one or more lights, the controller being configured to direct light from the one or more lights in one or more specified directions.

17. The sound-dampening lighting apparatus of claim 16, wherein the one or more lights comprise a light emitting diode (LED) strip comprising a plurality of LED lights.

18. The sound-dampening lighting apparatus of claim 16, wherein the lighting apparatus is designed for a specified room according to one or more room characteristics, such that a specified minimum amount of light is provided by the lighting apparatus and a minimum amount of sound dampening is provided for the room.

* * * * *